US009548170B2

(12) United States Patent
Crooks et al.

(10) Patent No.: US 9,548,170 B2
(45) Date of Patent: Jan. 17, 2017

(54) ELECTRICAL SWITCHING APPARATUS WITH TERMINAL GUARD ASSEMBLY

(71) Applicant: Eaton Corporation, Cleveland, OH (US)

(72) Inventors: William Michael Crooks, Sumter, SC (US); Charles Bradley Anderson, Manning, SC (US); Michael Paul Puskar, Carnegie, PA (US); David Michael Olszewski, Coraopolis, PA (US); Javvad Qasimi, Pittsburgh, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/700,720

(22) Filed: Apr. 30, 2015

(65) Prior Publication Data

US 2016/0211093 A1 Jul. 21, 2016

Related U.S. Application Data

(60) Provisional application No. 62/104,973, filed on Jan. 19, 2015.

(51) Int. Cl.
*H01H 9/02* (2006.01)
*H01H 71/02* (2006.01)
(Continued)

(52) U.S. Cl.
CPC ..... *H01H 9/0264* (2013.01); *H01H 71/0264* (2013.01); *H01H 71/08* (2013.01); *H01H 73/06* (2013.01); *H01H 2223/044* (2013.01)

(58) Field of Classification Search
CPC ..... H01H 9/0264; H01H 71/08; H01R 13/44; H01R 13/447
(Continued)

(56) References Cited

U.S. PATENT DOCUMENTS 5,150,091 A 9/1992 Hart et al.
5,493,092 A 2/1996 Rowe
(Continued)

FOREIGN PATENT DOCUMENTS

DE 11 66 869 B 4/1964
DE 11 78 129 B 9/1964
(Continued)

OTHER PUBLICATIONS

European Patent Office, Partial International Search Report (Corresponding PCT/US2016/012559), Apr. 11, 2016, 9 pp.

*Primary Examiner* — Vanessa Girardi
(74) *Attorney, Agent, or Firm* — Eckert Seamans; John Powers; Philip Levy

(57) ABSTRACT

A guard assembly is for an electrical switching apparatus of an electrical system. The electrical system includes a number of conductors each having an insulated portion and an exposed portion that meet at a junction. The electrical switching apparatus includes a housing and a number of terminals connected to the exposed portion of a conductor. The guard assembly comprises: an interconnect member coupled to the housing; and a number of guard members each comprising: a first portion coupled to the interconnect member, and a second portion extending from the first portion away from the housing, the second portion comprising: a first distal end located at the first portion, and a second distal end opposite and distal from the first distal end. Each of the guard members has an opening. The opening receives a conductor. Each junction is located between a second distal end and a terminal.

14 Claims, 9 Drawing Sheets

(51) Int. Cl.
*H01H 71/08* (2006.01)
*H01H 73/06* (2006.01)

(58) Field of Classification Search
USPC .... 200/304, 305; 335/202; 218/77, 155–157
See application file for complete search history.

(56) References Cited

U.S. PATENT DOCUMENTS

| | | | | |
|---|---|---|---|---|
| 5,933,066 | A | 8/1999 | Chontas et al. | |
| 7,495,534 | B2 * | 2/2009 | Oh | H01H 71/08 335/132 |
| 8,618,897 | B2 * | 12/2013 | Gerving | H01H 9/0264 200/304 |
| 2013/0307650 | A1 | 11/2013 | Gerving | |
| 2014/0151201 | A1 | 6/2014 | Sisley et al. | |

FOREIGN PATENT DOCUMENTS

| | | | |
|---|---|---|---|
| DE | 23 13 245 | A1 | 9/1974 |
| DE | 297 07 161 | U1 | 7/1997 |
| JP | H05 234493 | A | 9/1993 |
| WO | 2009/025483 | A2 | 2/2009 |

* cited by examiner

ELECTRICAL SWITCHING APPARATUS WITH TERMINAL GUARD ASSEMBLY

CROSS-REFERENCE TO RELATED APPLICATION

This application claims priority from and claims the benefit of U.S. Provisional Patent Application Ser. No. 62/104,973, filed Jan. 19, 2015.

BACKGROUND

Field

The disclosed concept pertains generally to electrical systems. The disclosed concept also pertains to electrical switching apparatus, such as circuit breakers, for electrical systems. The disclosed concept further pertains to guard assemblies for electrical switching apparatus.

Background Information

Electrical apparatus, such as electrical switching apparatus, are used to protect electrical circuitry from damage due to a trip condition, such as, for example, an overcurrent condition, an overload condition, an undervoltage condition, a relatively high level short circuit or fault condition, a ground fault or arc fault condition. Circuit breakers, for example, commonly include wiring terminals as a means to attach wires. While the wires are generally insulated, the end that attaches to the circuit breaker wiring terminal has the insulation removed (i.e., stripped).

It is common that the stripped portion of these wires extends to some degree outside the circuit breaker wiring terminal, such that, when a person is exposed to the circuit breaker and associated wiring, the person is also exposed to some portion of the uninsulated wires, and possibly also the uninsulated portion of the circuit breaker wiring terminal. This exposure to uninsulated electrically energized conductors (wires and/or wiring terminals) allows for the possibility of inadvertent contact by a person, tool, or the like, while performing various types of service or maintenance activities. It also allows a condition whereas a person may potentially be exposed to an arc flash hazard.

There is, therefore, room for improvement in electrical systems, and in electrical switching apparatus and guard assemblies therefor.

SUMMARY

These needs and others are met by embodiments of the disclosed concept, which are directed to a guard assembly, which among other benefits, guards the exposed portion of a conductor.

As one aspect of the disclosed, a guard assembly for an electrical switching apparatus of an electrical system is provided. The electrical system includes a number of conductors each having an insulated portion and an exposed portion. The exposed portion and the insulated portion meet at a junction. The electrical switching apparatus includes a housing and a number of terminals located internal with respect to the housing. Each of the terminals are connected to the exposed portion of a corresponding one of the conductors. The guard assembly comprises: an interconnect member coupled to the housing; and a number of guard members each comprising: a first portion coupled to the interconnect member, and a second portion extending from the first portion away from the housing, the second portion comprising: a first distal end located at the first portion, and a second distal end opposite and distal from the first distal end. Each of the guard members has an opening. The opening receives at least one of the conductors. Each junction is located between a corresponding second distal end and a corresponding one of the terminals.

As another aspect of the disclosed concept, an electrical switching apparatus of an electrical system is provided. The electrical system includes a number of conductors each having an insulated portion and an exposed portion. The exposed portion and the insulated portion meet at a junction. The electrical switching apparatus comprises: a housing; a number of terminals located internal with respect to the housing, each of the terminals being connected to the exposed portion of a corresponding one of the conductors; and a guard assembly comprising: an interconnect member coupled to the housing; and a number of guard members each comprising: a first portion coupled to the interconnect member, and a second portion extending from the first portion away from the housing, the second portion comprising: a first distal end located at the first portion, and a second distal end opposite and distal from the first distal end. Each of the guard members has an opening. The opening is structured to receive at least one of the conductors. Each junction is located between a corresponding second distal end and a corresponding one of the terminals.

As another aspect of the disclosed concept, an electrical system is provided. The electrical system comprises: a number of conductors each comprising an insulated portion and an exposed portion, the exposed portion and the insulated portion meeting at a junction; and an electrical switching apparatus comprising: a housing, a number of terminals located internal with respect to the housing, each of the terminals being connected to the exposed portion of a corresponding one of the conductors, and a guard assembly comprising: an interconnect member coupled to the housing, and a number of guard members each comprising: a first portion coupled to the interconnect member, and a second portion extending from the first portion away from the housing, the second portion comprising: a first distal end located at the first portion, and a second distal end opposite and distal from the first distal end. Each of the guard members has an opening. The opening receives at least one of the conductors. Each junction is located between a corresponding second distal end and a corresponding one of the terminals.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "coupling member" refers to any suitable connecting or tightening mechanism expressly including, but not limited to, rivets, screws, bolts and the combinations of bolts and nuts (e.g., without limitation, lock nuts) and bolts, washers and nuts, zip ties, wire ties, tape and/or an adhesive.

Figure 1:
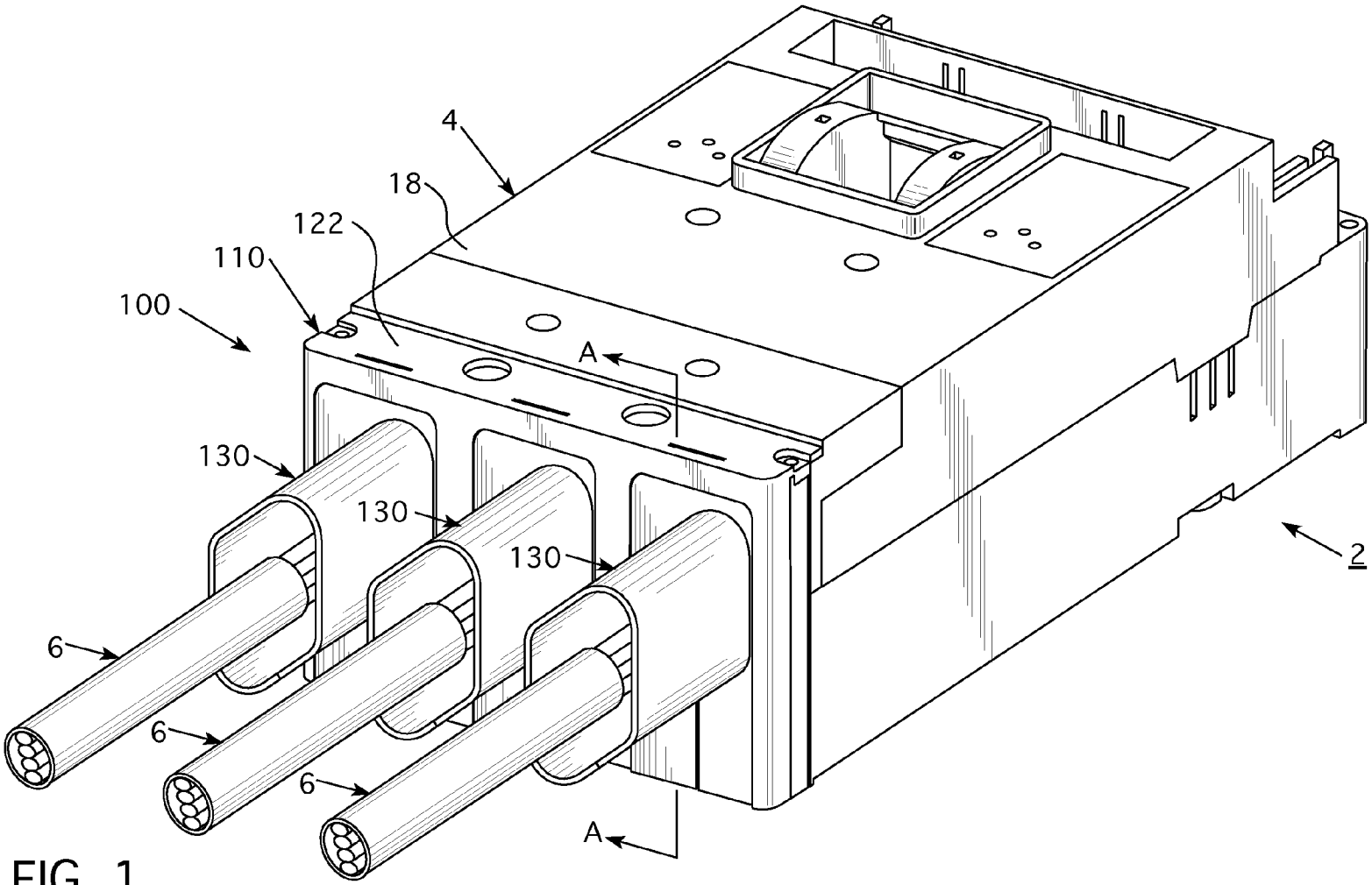
FIG. 1 is a simplified isometric view of an electrical system, in accordance with a non-limiting embodiment of the disclosed concept.

FIG. 1 shows an electrical system 2 in accordance with a non-limiting embodiment of the disclosed concept. The electrical system 2 includes an electrical switching apparatus (e.g., without limitation, molded case circuit breaker 4) and a number of conductors (see, for example, three conductors 6, shown in simplified form in the example of FIG. 1) for each of the poles of the circuit breaker 4. As will be discussed in greater detail below, the circuit breaker 4 includes a guard assembly 100 that protects operators from exposure to portions of the conductors 6 and the circuit breaker 4.

The guard assembly 100 includes an insulative interconnect member 110 and a number of insulative guard members 130 connected to the interconnect member 110. The conductors 6 each extend entirely through a corresponding one of the guard members 130. The guard members 130 are each preferably made of an elastomeric material. The interconnect member 110 is preferably made of a thermoplastic (e.g., an injection molded piece).

Figure 1A:
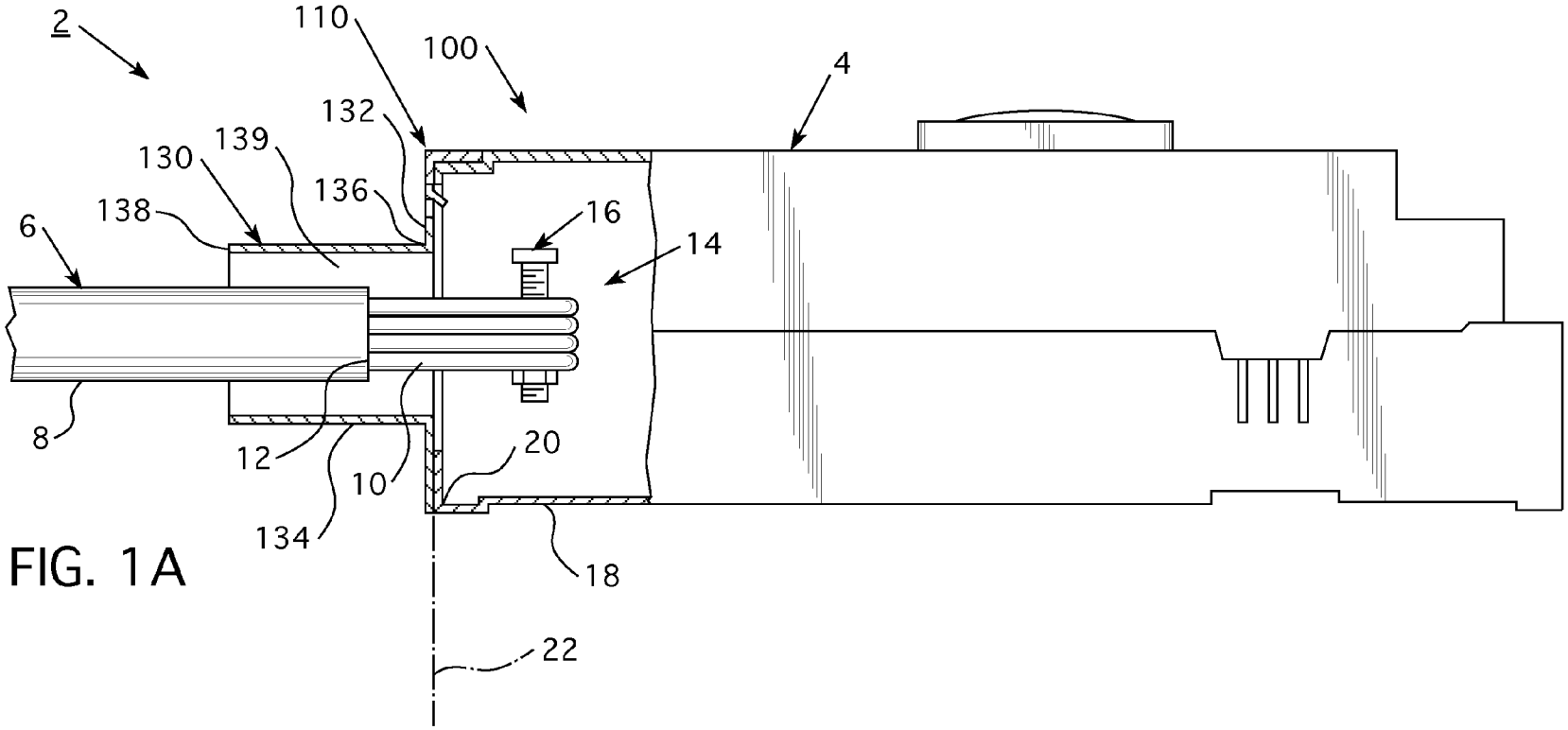
FIG. 1A is a section view of the electrical system of FIG. 1, taken along line A-A of FIG. 1.

FIG. 1A shows a simplified section view of the electrical system 2 of FIG. 1. As shown, the conductor 6 has an insulated portion 8, an exposed portion 10, and a junction 12 separating the insulated portion 8 from the exposed portion 10. The exposed portion 10 terminates and is connected to a corresponding terminal 14 of the circuit breaker 4. More specifically, the terminal 14 includes a terminal screw 16 that directly engages the exposed portion 10 of the conductor 6 in order to electrically connect the conductor 6 with the circuit breaker 4. In this manner, external electrical systems (not shown) are able to be electrically connected to the circuit breaker 4. Furthermore, the circuit breaker 4 has a housing 18. The housing 18 has a distal end portion 20 located proximate the terminal 14. The distal end portion 20 is located in a plane 22. As shown, the exposed portion 10 extends from the terminal 14 through the plane 22. In other words, a portion of the exposed portion 10 is located external the housing 18.

Each of the guard members 130 includes a planar portion 132 and a tubular portion 134 that is generally perpendicular to the planar portion 132. The tubular portion 134 has a distal end 136 located at the planar portion 132, and a distal end 138 located opposite and distal from the first distal end 136. The guard member 130 also has an opening 139 extending through both the tubular portion 134 and the planar portion 132. The conductor 6 extends through the opening 139 in order to be connected to the terminal screw 16. As shown in FIG. 1A, the junction 12 is located between the distal end 138 and the terminal 14. Stated differently, the portion of the exposed portion 10 that extends external the housing 18 (i.e., the portion of the exposed portion 10 extending from the junction 12 to the plane 22) is located between the distal end 138 and the terminal 14. In other words, the entire exposed portion 10 of the conductor 6 is located internal with respect to the circuit breaker 4 (i.e., the exposed portion 10 extends from the junction 12 (a location entirely internal the guard member 130 of the circuit breaker 4) to the terminal 14 (a location entirely internal the housing 18 of the circuit breaker 4)). Stated differently, the entire exposed portion 10 is enclosed by (i.e., contained within) the housing 18, the interconnect member 110, and the guard member 130.

In this manner, the exposed portion 10 of the conductor 6, and the terminal 14 are advantageously well protected from inadvertent contact by an operator or a tool, therefore improving safety. More specifically, the housing 18, the interconnect member 110, and the guard member 130 surround the exposed portion 10 of the conductor 6. Because the interconnect member 110 and the guard member 130 are insulative, the likelihood of having an electrical pathway between an operator and the exposed portion 10, or between an operator and the terminal 14, is significantly diminished. For example, if an operator inadvertently contacts the guard member 130 and the guard member 130 deflects into the exposed portion 10, the insulative properties of the guard member 130 will advantageously protect the operator from electrical exposure. Additionally, if an operator contacts the distal end 138 and the distal end 138 deflects into the insulated portion 8, the insulative properties of each of the guard member 130 and the insulated portion 8 of the conductor 6 will advantageously protect the operator from electrical exposure.

Figure 2:
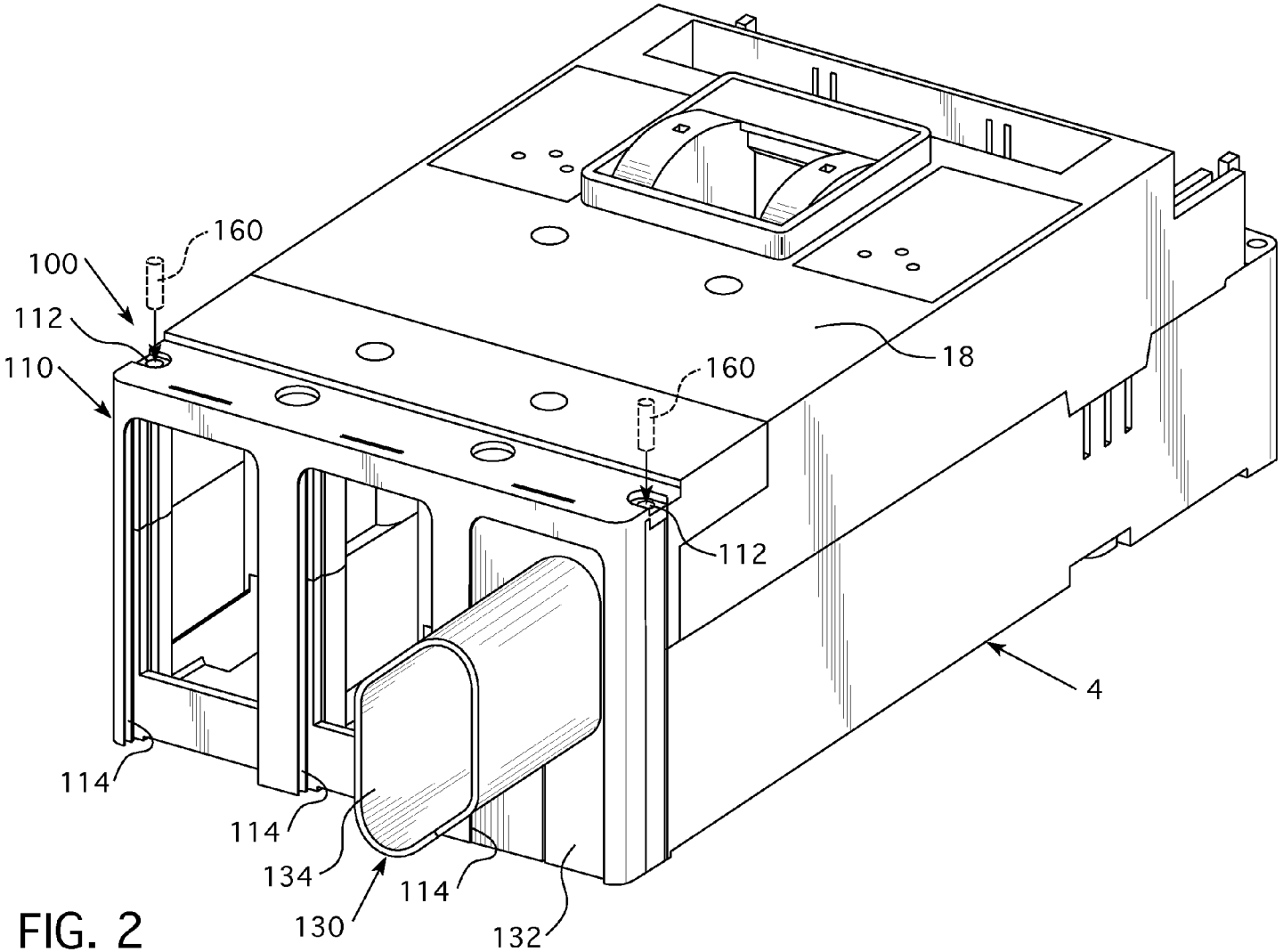
FIG. 2 is a partially assembled isometric view of an electrical switching apparatus and guard assembly therefor for the electrical system of FIG. 1.

FIG. 2 shows a portion of the circuit breaker 4. As shown, the interconnect member 110 further has a number of thru holes 112. The guard assembly 100 further includes a number of coupling members (see, for example, two coupling members 160, shown in simplified form in FIG. 2). The coupling members 160 extend through the respective thru holes 112 and into the housing 18 in order to couple the interconnect member 110 to the housing 18.

Figure 3:
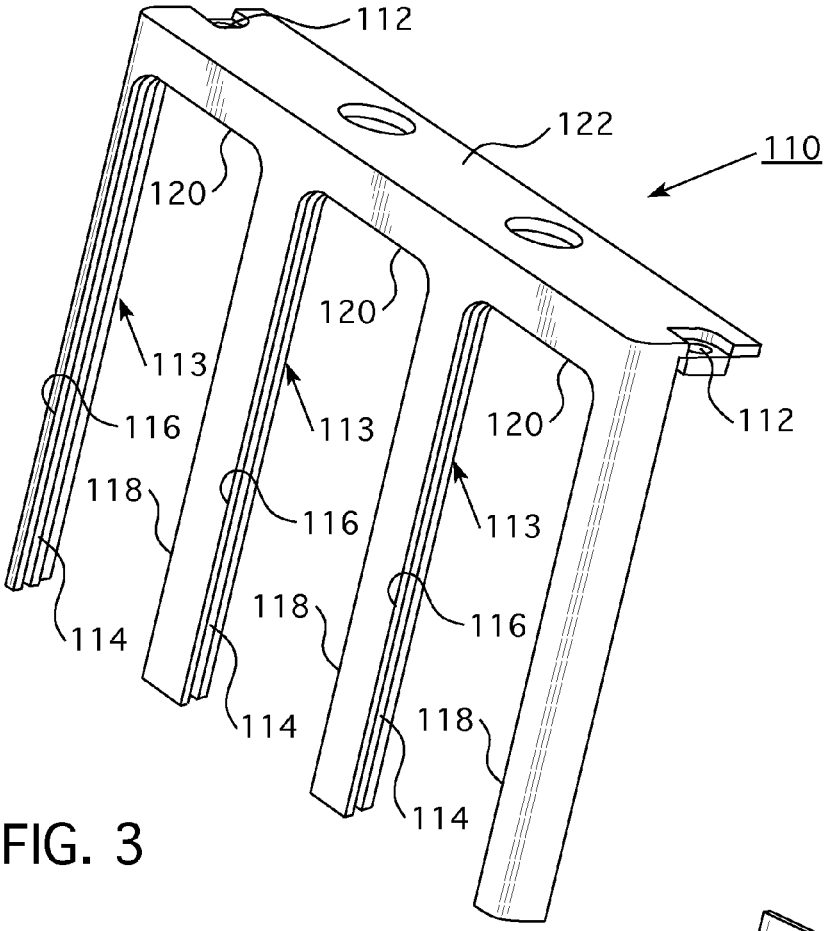
FIG. 3 is an isometric view of an interconnect member for the guard assembly.

FIG. 3 shows the interconnect member 110. As shown, the interconnect member 110 includes a number of receiving portions (see, for example, three receiving portions 113, shown in the example of FIG. 3) and a securing portion 122 that is perpendicular to the receiving portions 113. Each of the receiving portions 113 includes a first edge portion 116, a second edge portion 118, and a third edge portion 120. The first edge portion 116 is parallel to and spaced from the second edge portion 118. The third edge portion 120 is perpendicular to each of the first edge portion 116 and the second edge portion 118, and connects the first edge portion 116 to the second edge portion 118. Additionally, each of the receiving portions 113 has a slot 114. The slot 114 is located in each of the respective edge portions 116,118,120.

Figure 4:
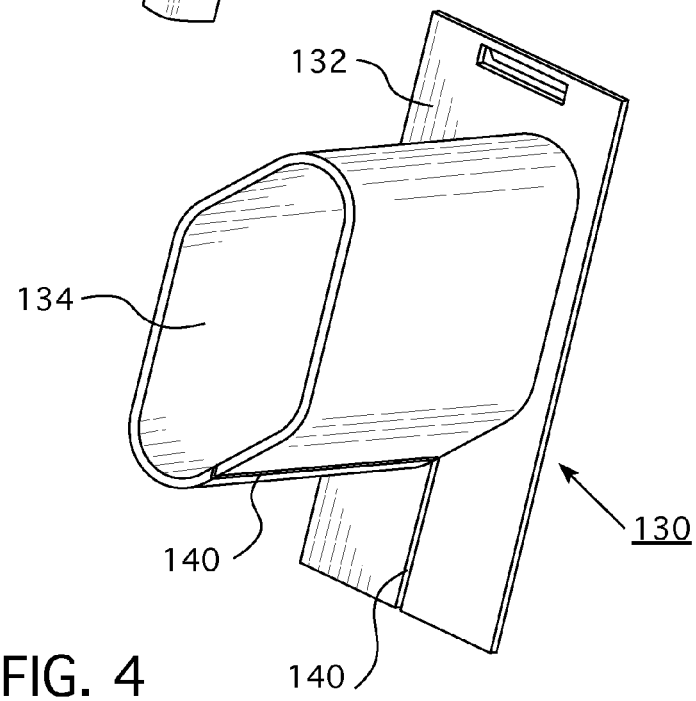
FIG. 4 is an isometric view of a guard member for the guard assembly.

FIG. 4 shows the guard member 130. As shown, the guard member 130 has a slit 140 that is located in each of the planar portion 132 and the tubular portion 134. The slit 140 extends entirely through the thickness of the guard member 130. In other words, the guard member 130 is separable (i.e., able to be opened) about the slit 140. Thus, during assembly of the circuit breaker 4, each of the respective guard members 130 is opened about the respective slit 140, and the each of the respective conductors 6 is inserted through the respective guard member 130. Furthermore, each of the respective planar portions 132 is then inserted into a respective one of the slots 114 in order to couple the respective guard member 130 to the interconnect member 110. Because the shape of the planar portion 132 is substantially the same as the shape of the receiving portion 113, the guard member 130 is advantageously able to be coupled to the interconnect member 110 by a friction fit mechanism without employing separate fastening members, thereby reducing cost.

Figure 5:
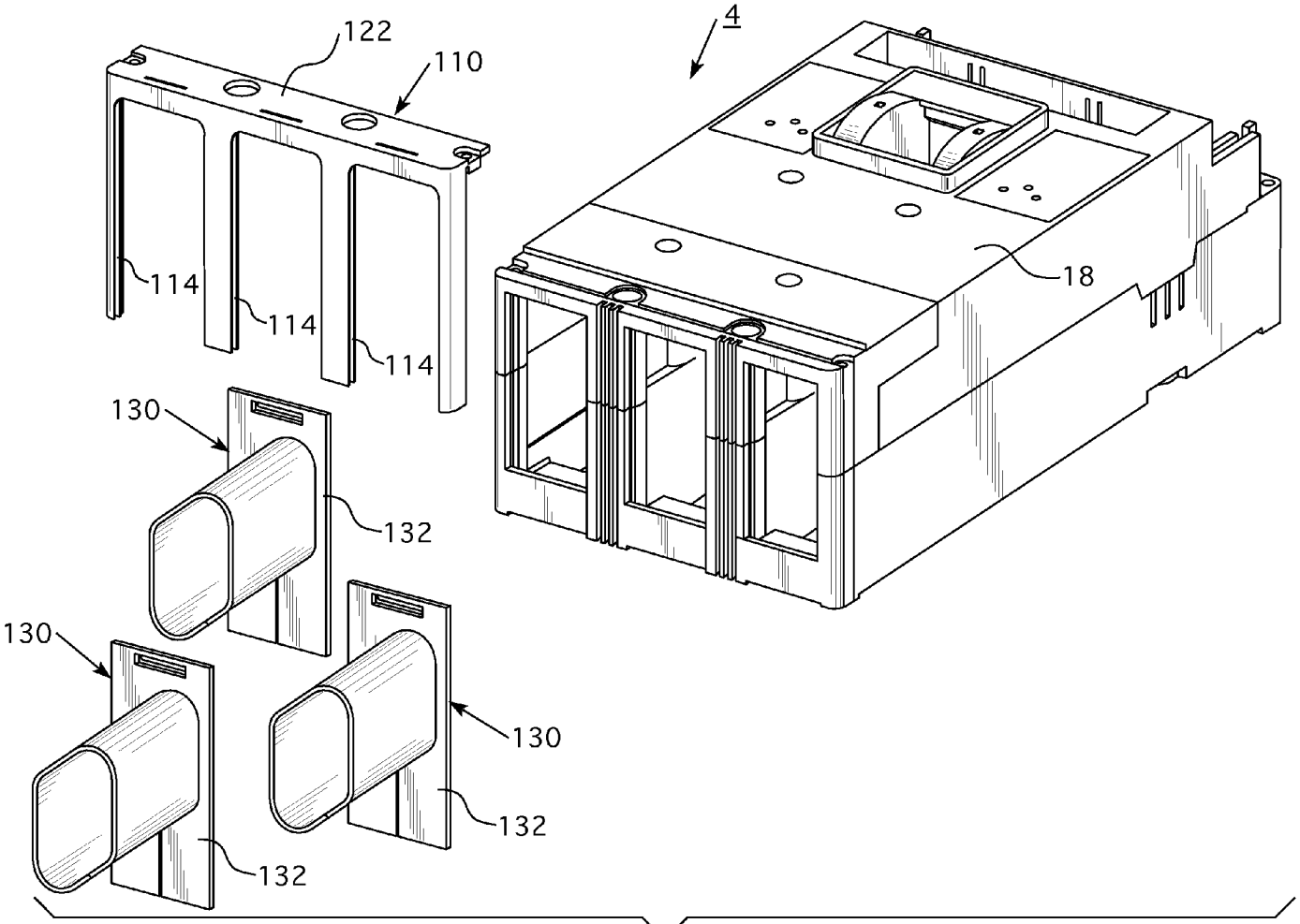
FIG. 5 is an exploded isometric view of the electrical switching apparatus for the electrical system of FIG. 1.

FIG. 5 shows an exploded isometric view of the circuit breaker 4. As shown, each of the planar portions 132 of the respective guard members 130 is structured to fit into a corresponding one of the slots 114 of the interconnect member 110. Additionally, the securing portion 122 is structured to be coupled to the housing 18.

Figure 6:
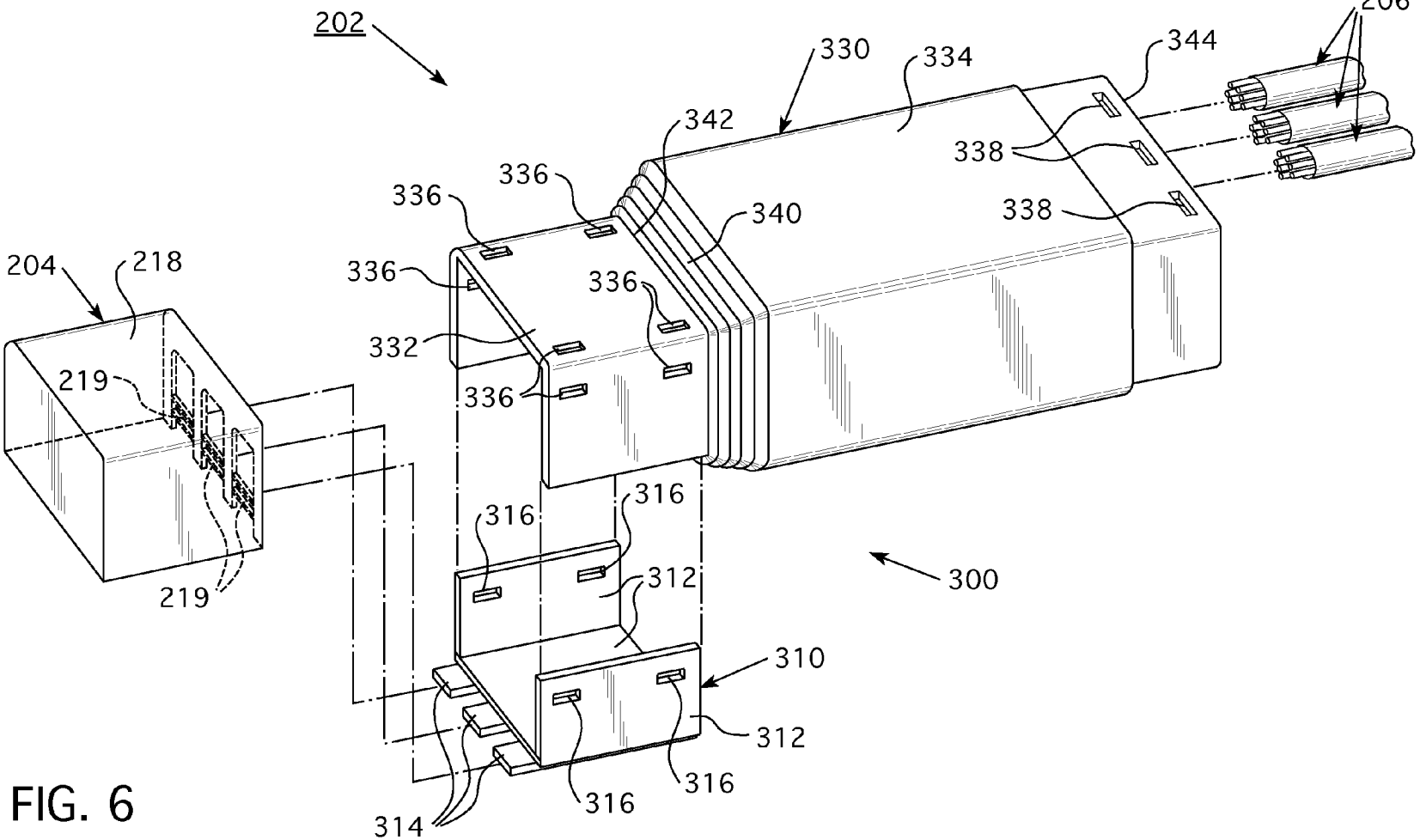
FIG. 6 is simplified exploded view of an electrical system, in accordance with another non-limiting embodiment of the disclosed concept.
Figure 7:
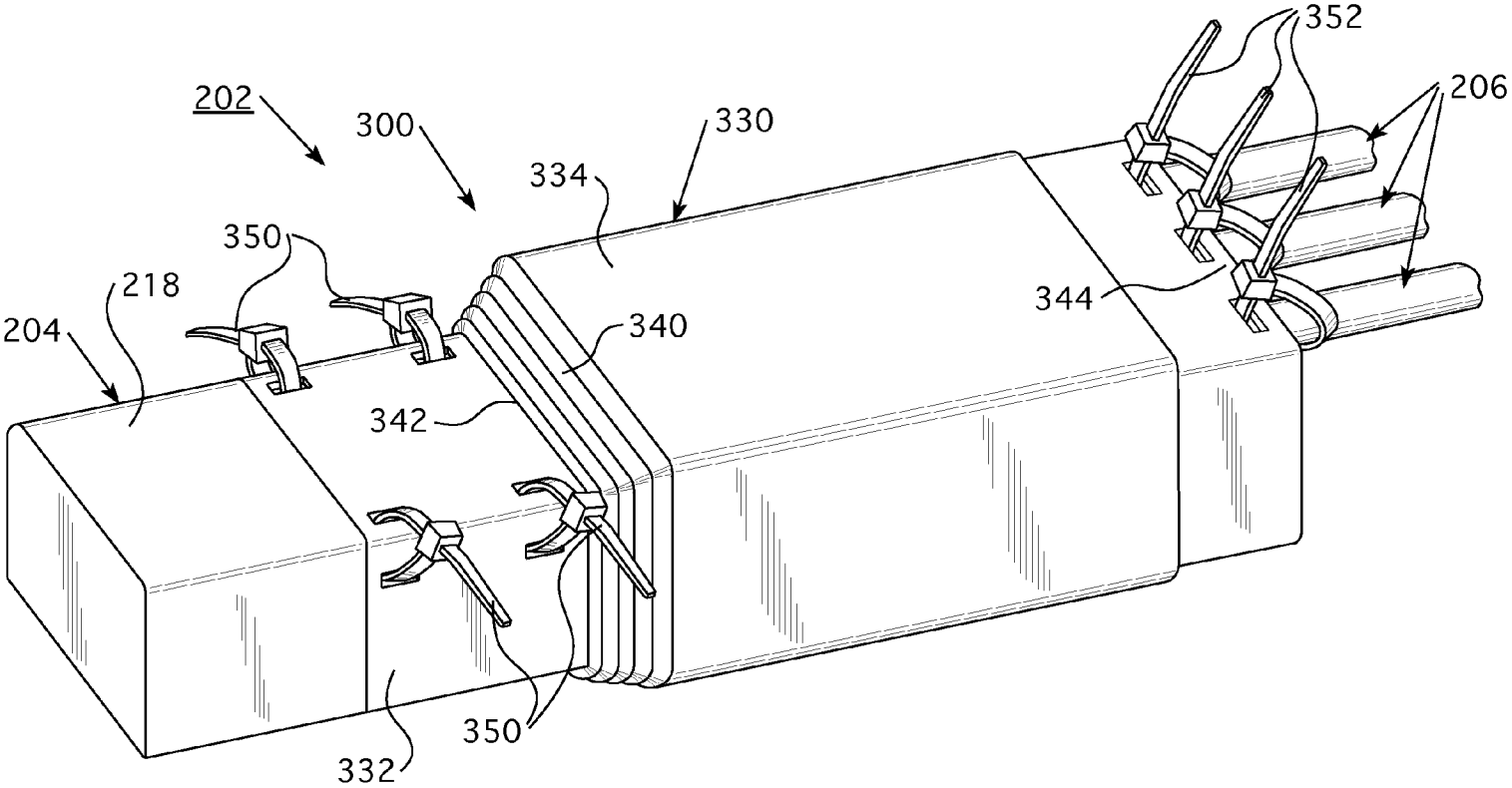
FIG. 7 is a simplified assembled view of the electrical system of FIG. 6.

It will be appreciated that the disclosed concept is not limited to the electrical system 2. For example, FIG. 6 and FIG. 7 show another electrical system 202 that includes an electrical switching apparatus (e.g., without limitation, molded case circuit breaker 204, shown in simplified form) and a number of conductors (see, for example, three conductors 206, shown in simplified form in the example of FIGS. 6 and 7) for each of the poles of the circuit breaker 204. As will be discussed in greater detail below, the circuit breaker 204 includes a guard assembly 300 to protect operators from exposure to an exposed portion of the conductors 206 and the circuit breaker 204. It will be appreciated that benefits associated with the guard assembly 100 and the electrical system 2 (FIGS. 1 and 2) likewise apply to the guard assembly 300 and the electrical system 202.

The guard assembly 300 includes an insulative interconnect member 310 and a single insulative guard member 330 connected to the interconnect member 310. The conductors 206 each extend entirely through the guard member 330 in order to be electrically connected with the terminals of the circuit breaker 204 in a similar manner as discussed above in association with the electrical system 2 (FIGS. 1 and 2). The guard member 330 is preferably made of an elastomeric material. The interconnect member 310 is preferably made of a thermoplastic (e.g., an injection molded piece).

The circuit breaker 204 includes a housing 218 and a plurality of terminals located internal the housing 218. Furthermore, the housing 218 has a number of slots (see, for example, three slots 219, shown in hidden line drawing in FIG. 6) and each of the terminals of the circuit breaker 204 is located near a corresponding one of the slots 219. The interconnect member 310 includes a body portion 312 and a plurality of tangs 314 extending from the body portion 312. It will be appreciated that each of the tangs 314 extends into a corresponding one of the slots 219 in order to couple the interconnect member 310 to the housing 218 of the circuit breaker 204.

Continuing to refer to FIG. 6, the guard member 330 includes a first portion 332 and a second portion 334 extending from the first portion 332 away from the housing 218. The body portion 312 of the interconnect member 310 and the first portion 332 of the guard member 330 form an enclosed region that receives each of the conductors 206. For example, FIG. 7 shows an assembled view of the electrical system 202. It will be appreciated that each of the conductors 206 extends through the guard member 330 in order to be electrically connected to the respective terminals of the circuit breaker 204. Thus, the insulative properties of the interconnect member 310 and the guard member 330, which enclose the exposed portions of the conductors 206, advantageously protect operators from inadvertent contact with the exposed portions of the conductors 206.

The body portion 312 has a number of thru holes 316, and the first portion 332 of the guard member 330 has a number of apertures 336. Furthermore, the guard assembly 300 includes a number of coupling members (see, for example, coupling members 350, shown in FIG. 7) each extending through a corresponding one of the thru holes 316 and through a corresponding one of the apertures 336 in order to couple the guard member 330 to the interconnect member 310. The second portion 334 of the guard member 330 also has a number of thru holes 338. The guard assembly 300 additionally has another number of coupling members (see, for example, coupling members 352, shown in FIG. 7) that each extend through a corresponding one of the thru holes 338 in order to secure a corresponding one of the conductors 206 to the guard member 330.

The guard member 330 also preferably has a flexible bellows portion 340 located in the second portion 334 between opposing distal ends 342,344 of the second portion 334. In operation, the flexible bellows portion 340 advantageously allows the guard member 330 to flex in order to allow the conductors 206 to properly mate with the terminals of the circuit breaker 204. For example, when the conductors 206 are secured to the guard member 330, the flexible bellows portion 340 allows the exposed portions (FIG. 6) of the conductors 206 to move independently with respect to the first portion 332 of the guard member 330 in order to properly align with the respective terminals.

Figure 8:
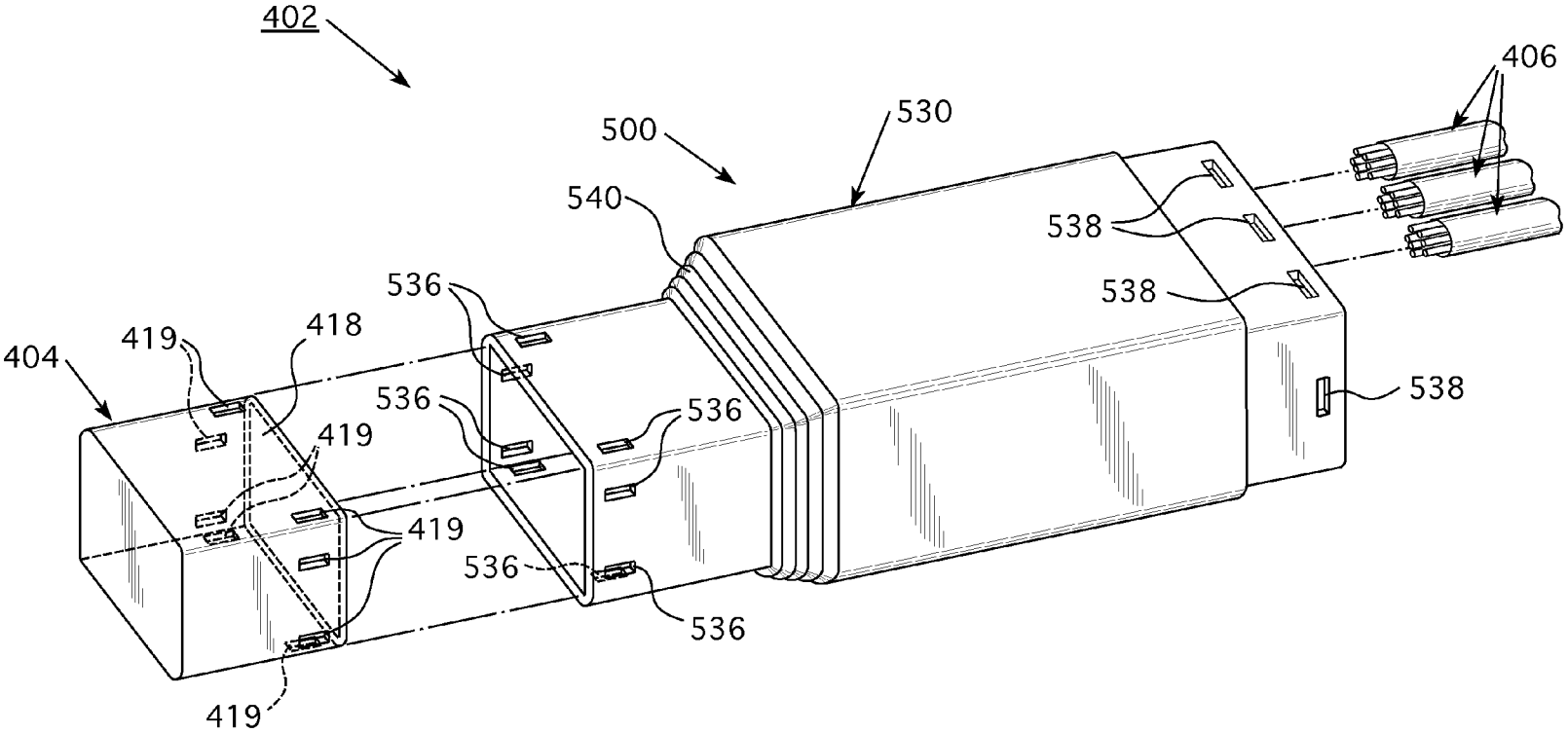
FIG. 8 is simplified exploded view of an electrical system, in accordance with another non-limiting embodiment of the disclosed concept.
Figure 9:
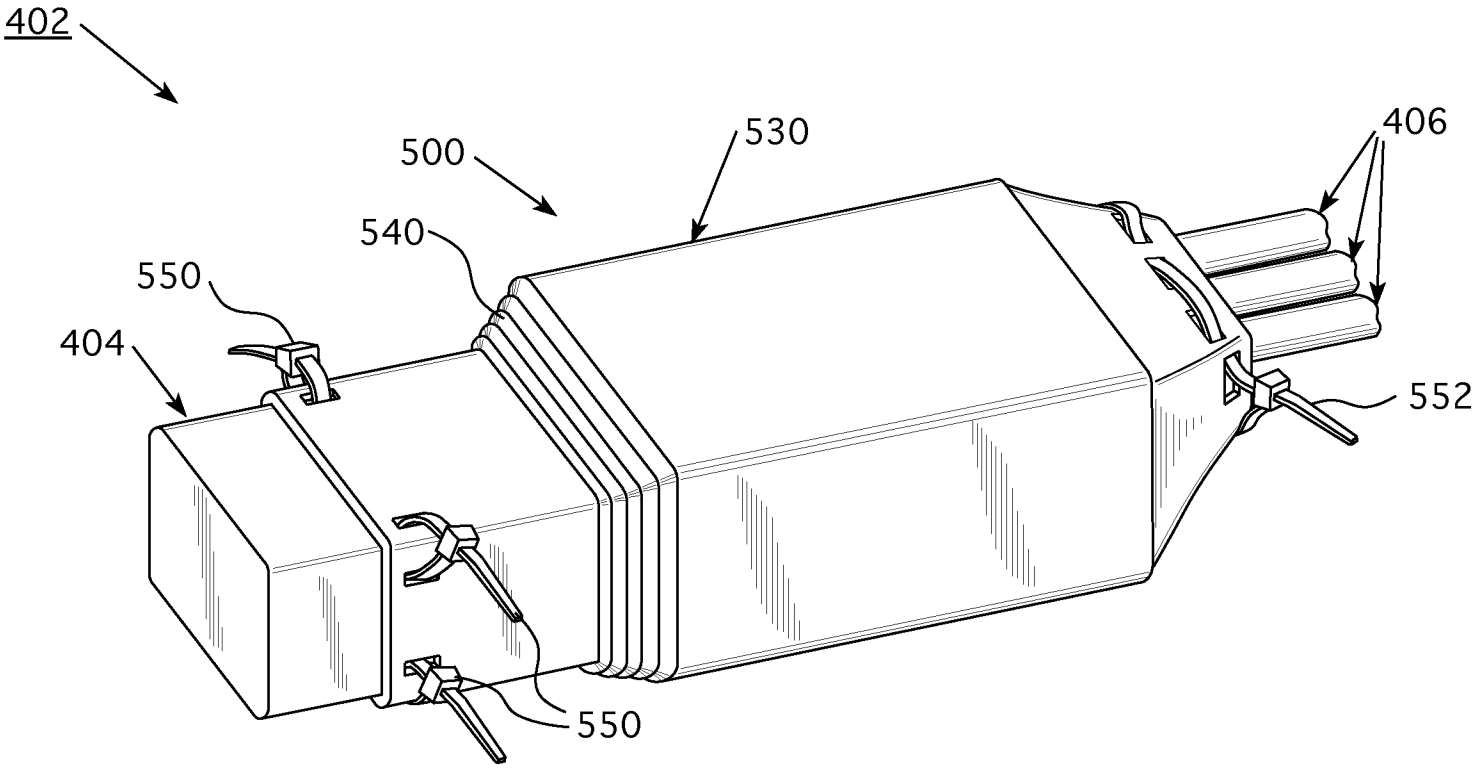
FIG. 9 is a simplified assembled view of the electrical system of FIG. 8.

FIG. 8 and FIG. 9 show an electrical system 402 in accordance with another non-limiting embodiment of the disclosed concept. The electrical system 402 includes an electrical switching apparatus (e.g., without limitation, molded case circuit breaker 404, shown in simplified form in the example of FIGS. 8 and 9) and a number of conductors (see, for example, three conductors 406, shown in simplified form in the example of FIGS. 8 and 9) for each of the poles of the circuit breaker 404. As will be discussed in greater detail below, the circuit breaker 404 includes a guard assembly 500 to protect operators from exposure to an exposed portion of the conductors 406 and the circuit breaker 404. It will be appreciated that benefits associated with the guard assemblies 100,300 and the electrical systems 2,202 (FIGS. 1, 2, 6 and 7) likewise apply to the guard assembly 500 and the electrical system 402.

The circuit breaker 404 includes a housing 418 that has a number of slots (see, for example, slots 419, shown in FIG. 8) extending through the thickness of the housing 418, and a plurality of terminals located internal the housing 418. The guard assembly 500 includes a single insulative tubular guard member 530 that has a number of thru holes (see, for example, thru holes 536 and thru holes 538, shown in FIG. 8). The guard member 530 is preferably made of an elastomeric material. The conductors 406 each extend entirely through the guard member 530 in order to be electrically connected with the terminals of the circuit breaker 404 in a similar manner as discussed above in association with the electrical systems 2,202 (FIGS. 1, 2, 6 and 7). The guard assembly 500 further includes a number of interconnect members (see, for example, coupling members 550,552, shown in FIG. 9).

In operation, the circuit breaker 404 partially extends into (i.e., is partially enclosed by or contained by) the guard member 530 in order that each of the thru holes 536 is aligned with (i.e., overlays or is located directly on top of) a corresponding one of the slots 419. Furthermore, each of the coupling members 550 preferably extends through two of the slots 419 of the circuit breaker 404 and two corresponding thru holes 536 of the guard member 530 in order to couple the guard member 530 to the circuit breaker 404. Additionally, the coupling member 552 extends into the thru holes 538 in order to secure the conductors 406 to the guard member 530. When the coupling member 552 is secured to the conductors 406, the guard member 530 is under tension. Stated differently, because the guard member 530 is relatively flexible, the coupling member 552 advantageously causes the guard member 530 to deflect in order to secure the conductors 406 to the guard member 530.

Similar to the guard member 330 (FIGS. 6 and 7), the guard member 530 also preferably has a flexible bellows portion 540 located between opposing distal ends of the guard member 530. The flexible bellows portion 540 provides similar advantages as the flexible bellows portion 340 (FIG. 6 and FIG. 7). More specifically, the flexible bellows portion 540 advantageously allows the guard member 530 to flex in order to allow the conductors 406 to properly mate with the terminals of the circuit breaker 404.

Although the disclosed concept has been described in association with the molded case circuit breakers 4,204,404 it will be appreciated that the disclosed concept is applicable to any known or suitable alternative electrical switching apparatus, such as, for example and without limitation, a power circuit breaker (not shown) and/or a fusible switch (not shown).

Accordingly, it will be appreciated that the disclosed concept provides for an improved (e.g., without limitation, better protected) electrical system 2,202,402 and electrical switching apparatus 4,204,404 and guard assembly 100,300, 500 therefor, which among other benefits, minimizes and/or eliminates the possibility that the exposed portion 10 of a conductor 6,206,406 will inadvertently come into contact with an operator and/or a tool. More specifically, dangerous inadvertent contact with uninsulated conductors is advantageously minimized and/or eliminated.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A guard assembly for an electrical switching apparatus of an electrical system, said electrical system comprising a number of conductors each comprising an insulated portion and an exposed portion, the exposed portion and the insulated portion meeting at a junction, said electrical switching apparatus comprising a housing and a number of terminals disposed internal with respect to said housing, each of the terminals being connected to the exposed portion of a corresponding one of said conductors, said guard assembly comprising:

an interconnect member structured to be coupled to said housing; and a number of guard members each comprising:

a first portion coupled to said interconnect member, and a second portion structured to extend from the first portion away from said housing, the second portion comprising:

a first distal end disposed at the first portion, and a second distal end opposite and distal from the first distal end;

wherein each of said guard members has an opening, the opening being structured to receive at least one of said conductors;

wherein each junction is structured to be disposed between a corresponding second distal end and a corresponding one of the terminals; wherein each of said number of guard members has a slit; and wherein the slit extends through each of the first portion and the second portion.

2. The guard assembly of claim 1 wherein said number of guard members comprises a first guard member, a second guard member, and a third guard member; and wherein each of said first guard member, said second guard member, and said third guard member is spaced from each other.

3. The guard assembly of claim 1 wherein each of said interconnect member and said number of guard members is insulative.

4. The guard assembly of claim 1 wherein each of said number of guard members is structured to open about said respective slit.

5. The guard assembly of claim 1 wherein said interconnect member comprises a number of receiving portions each having a slot; wherein each respective receiving portion comprises a first edge portion, a second edge portion, and a third edge portion; wherein each respective slot is disposed in each of said respective first edge portion, said respective second edge portion, and said respective third edge portion; and wherein the first portion of each respective guard member is disposed in a respective one of said number of slots.

6. The guard assembly of claim 5 wherein said first edge portion is parallel to and spaced from said second edge portion; wherein said third edge portion is perpendicular to each of said first edge portion and said second edge portion; and wherein said third edge portion connects said first edge portion to said second edge portion.

7. The guard assembly of claim 5 wherein said interconnect member further has a securing portion structured to be mounted to said housing; and wherein said securing portion is perpendicular to each of said number of receiving portions.

8. A guard assembly for an electrical switching apparatus of an electrical system, said electrical system comprising a number of conductors each comprising an insulated portion and an exposed portion, the exposed portion and the insulated portion meeting at a junction, said electrical switching apparatus comprising a housing and a number of terminals disposed internal with respect to said housing, each of the terminals being connected to the exposed portion of a corresponding one of said conductors, said guard assembly comprising:

an interconnect member structured to be coupled to said housing; and a number of guard members each comprising:

a first portion coupled to said interconnect member, and a second portion structured to extend from the first portion away from said housing, the second portion comprising:

a first distal end disposed at the first portion, and a second distal end opposite and distal from the first distal end;

wherein each of said guard members has an opening, the opening being structured to receive at least one of said conductors;

wherein each junction is structured to be disposed between a corresponding second distal end and a corresponding one of the terminals; and wherein each of said number of guard members is made of an elastomeric material.

9. The guard assembly of claim 8 wherein each respective first portion is generally planar; and wherein each respective second portion is perpendicular to the respective first portion.

10. The guard assembly of claim 8 wherein said number of guard members is a single guard member; and wherein said single guard member comprises a flexible bellows portion disposed between the first distal end and the second distal end.

11. The guard assembly of claim 8 wherein said guard assembly further comprises a number of coupling members; wherein each of said number of coupling members extends through said interconnect member; and wherein each of said coupling members is structured to couple said interconnect member to said housing.

12. An electrical system comprising:

a number of conductors each comprising an insulated portion and an exposed portion, the exposed portion and the insulated portion meeting at a junction; and an electrical switching apparatus comprising:

a housing, a number of terminals disposed internal with respect to said housing, each of the terminals being connected to the exposed portion of a corresponding one of said conductors, and a guard assembly comprising:

an interconnect member coupled to said housing, and a number of guard members each comprising:

a first portion coupled to said interconnect member, and a second portion extending from the first portion away from said housing, the second portion comprising:

a first distal end disposed at the first portion, and a second distal end opposite and distal from the first distal end;

wherein each of said guard members has an opening, the opening receiving at least one of said conductors;

wherein each junction is disposed between a corresponding second distal end and a corresponding one of the terminals; wherein said electrical switching apparatus has a plurality of slots; wherein said number of guard members is a single tubular guard member having a plurality of thru holes; wherein said electrical switching apparatus partially extends into said single tubular guard member in order that each of the slots is aligned with a corresponding one of the thru holes; wherein said guard assembly further comprises at least one other interconnect member; and wherein each of said interconnect members extends through at least one of the slots and at least one of the corresponding thru holes in order to couple said single tubular guard member to said electrical switching apparatus.

13. The electrical system of claim 12 wherein the entire exposed portion of each respective conductor is disposed internal with respect to said electrical switching apparatus.

14. An electrical switching apparatus of an electrical system, said electrical system comprising a number of conductors each comprising an insulated portion and an exposed portion, the exposed portion and the insulated portion meeting at a junction, said electrical switching apparatus comprising:

a housing;

a number of terminals disposed internal with respect to said housing, each of the terminals being connected to the exposed portion of a corresponding one of said conductors; and a guard assembly comprising:

an interconnect member coupled to said housing; and a number of guard members each comprising:

a first portion coupled to said interconnect member, and a second portion extending from the first portion away from said housing, the second portion comprising:

a first distal end disposed at the first portion, and a second distal end opposite and distal from the first distal end;

wherein each of said guard members has an opening, the opening being structured to receive at least one of said conductors;

wherein each junction is structured to be disposed between a corresponding second distal end and a corresponding one of the terminals; wherein said housing has a plurality of slots; wherein said number of terminals is a plurality of terminals each disposed proximate a corresponding one of the slots; wherein said interconnect member comprises a body portion and a plurality of tangs extending from said body portion; wherein each of said tangs extends into a corresponding one of the slots in order to couple said interconnect member to said housing; wherein said number of guard members is a single guard member; wherein said body portion has a number of thru holes; wherein the first portion of said single guard member has a number of apertures; and wherein said guard assembly further comprises a number of coupling members each extending through a corresponding one of the thru holes and through a corresponding one of the apertures in order to couple said guard member to said interconnect member.

* * * * *